US006070047A

United States Patent [19]

Ichinose et al.

[11] Patent Number: 6,070,047

[45] Date of Patent: May 30, 2000

[54] IMAGE FORMING APPARATUS WITH AN IMAGE BEARING MEMBER AND INTERMEDIATE TRANSFER MEMBER CONTACT-SEPARATION MECHANISM

[75] Inventors: Kimitaka Ichinose, Susono; Shinichi Tsukida, Yono, both of Japan

[73] Assignee: Canon Kabushiki Kaisha, Tokyo, Japan

[21] Appl. No.: 09/031,768

[22] Filed: Feb. 27, 1998

[30] Foreign Application Priority Data

Mar. 3, 1997 [JP] Japan ..... 9-048258

[51] Int. Cl.[7] ..... G03G 21/00; G03G 15/02; G03G 15/16

[52] U.S. Cl. ..... 399/350; 399/174; 399/308; 399/313; 399/314

[58] Field of Search ..... 399/168, 174, 399/176, 302, 308, 71, 350, 98, 99, 313, 314, 357

[56] References Cited

U.S. PATENT DOCUMENTS 5,079,597 1/1992 Mauer et al. ..... 399/302

5,204,034 4/1993 Sasame et al. ..... 264/138

5,752,130 5/1998 Tanaka et al. ..... 399/99 X

*Primary Examiner*—Susan S. Y. Lee

*Attorney, Agent, or Firm*—Fitzpatrick, Cella, Harper & Scinto

[57] ABSTRACT

An image forming apparatus prevents the transfer, onto an intermediate transfer member, of the remaining toner after having passed under a cleaning blade by the small vibration phenomenon thereof induced by the shock resulting from the stopping or starting of the rotation of a photosensitive drum. At the start-up of the image forming apparatus or at the end of the printing operation, the intermediate transfer member is separated from the photosensitive drum. Then, after the start of the printing operation, the photosensitive drum is rotated while it is separated from the intermediate transfer member. Then the photosensitive drum is contacted with the intermediate transfer member after an abutting portion on the photosensitive drum, where the cleaning blade is in contact in the stopped state of the image forming apparatus, passes through a position opposed to the intermediate transfer member, and the image forming operation is then initiated. In this manner, the remaining toner that has passed under the cleaning blade is not transferred onto the intermediate transfer member.

33 Claims, 8 Drawing Sheets

AFTER MAIN BODY IS STOPPED UNTIL A PORTION PASSES THROUGH B POSITION

AFTER A PORTION PASSES THROUGH B POSITION

AFTER A PORTION PASSES THROUGH B POSITION

AFTER MAIN BODY IS STOPPED UNTIL A PORTION PASSES THROUGH B POSITION

AFTER A PORTION PASSES THROUGH B POSITION

AFTER MAIN BODY IS STOPPED UNTIL A PORTION PASSES THROUGH B POSITION

AFTER A PORTION PASSES THROUGH B POSITION

AFTER MAIN BODY IS STOPPED UNTIL A PORTION PASSES THROUGH B POSITION

AFTER A PORTION PASSES THROUGH B POSITION

AFTER MAIN BODY IS STOPPED UNTIL A PORTION PASSES THROUGH B POSITION

MAIN BODY STOPPED

MAIN BODY DRIVE STARTED

START IMAGE EXPOSURE OF IMAGE DATA
AFTER PREDETERMINED TIME PASSES
AFTER M PASSES TOP SENSOR 29

IMAGE FORMING APPARATUS WITH AN IMAGE BEARING MEMBER AND INTERMEDIATE TRANSFER MEMBER CONTACT-SEPARATION MECHANISM

BACKGROUND OF THE INVENTION

1. Field of the Invention

The present invention relates to an image forming apparatus such as an electrophotographic copying machine, a laser beam printer or the like.

2. Related Background Art

The image bearing member, employed in a four-colored full-color image forming apparatus of the electrophotographic system (for example a copying machine or a laser beam printer), is an electrophotographic photosensitive member composed of a metal drum surfacially provided with a photosensitive layer such as an organic photosensitive coating (OPC), and is rotated in a predetermined direction in response to a print start signal. The image bearing member, thus rotated, is surfacially charged uniformly to a predetermined potential, by the application of a charging bias voltage to a charger. Then the surface of the image bearing member is exposed to (irradiated by) the light of a specified wavelength, based on a signal from a controller. The electrostatic bharge in the irradiated portion is dissipated, whereby an electrostatic latent image is formed on the surface of the image bearing member.

Subsequently, a yellow developing unit, containing yellow toner and so positioned as to oppose to the image bearing member, is given a certain developing bias voltage, whereby the toner given a predetermined charge is deposited onto the electrostatic latent image present on the image bearing member to develop a visible toner image. Then the toner image on the image bearing member is subjected to a primary transfer onto an intermediate transfer member (for example intermediate transfer belt) positioned adjacent to the image bearing member and driven with a substantially same speed as that of the image bering member, by a primary transfer bias voltage of a polarity opposite to that of the toner present on the image bearing member.

The remaining toner of the primary transfer, which is not transferred to the intermediate transfer member in the above-mentioned primary transfer step but remains on the image bearing member, is removed by a cleaning device. The cleaning device is provided with a cleaning blade (cleaning member) of which end is maintained in counter contact with the rotating direction of the image bearing member (forming an acute angle with the tangential line at the downstream side in the moving direction) and mechanically scrapes off so-called "transfer remainder toner" which remains on the image bearing member after the primary transfer.

The above-explained steps are repeated also for the toners of other colors, namely of magenta, cyan and black, whereby toner images of four colors are superposed on the intermediate transfer member.

Subsequently a secondary transfer bias voltage of a polarity opposite to that of the toner images is applied to a secondary transfer device opposed to the intermediate transfer member and a transfer material such as paper is passed in this state between the intermediate transfer member and the secondary transfer device, whereby the toner images of four colors present on the intermediate transfer member are collectively transferred onto the transfer material. In this operation, so-called "secondary transfer remainder toner" which remains on the intermediate transfer member is removed by an intermediate transfer member cleaning member. For cleaning the intermediate transfer member, there are known a method of contacting a blade or a brush with the intermediate transfer member and mechanically scraping off the remainder toner, and a method of inversely charging the remainder toner on the intermediate transfer member, then re-transferring such remainder toner onto the image bearing member at the contact portion thereof with the intermediate transfer member and removing thus re-transferred toner by the cleaning member for the image bearing member.

The transfer material bearing the toner images of four colors transferred by the secondary transfer is transported to a fixing device, in which the toner images are fixed to the surface of the transfer material under the application of heat and pressure.

The transfer remainder toner (hereinafter collectively meaning the primary transfer remainder toner and the secondary transfer remainder toner) deposited on the surface of the image bearing member is removed by the cleaning blade which is so mounted that the end thereof is in counter contact with respect to the moving direction of the image bearing member. In the rotating state of the image bearing member at a constant speed (hereinafter also called "normal rotation state"), the image bearing member and the cleaning blade are maintained under a mutually tensioned constant state in which no gap is present therebetween, whereby the transfer remainder toner deposited on the surface of the image bearing member can be cleanly removed.

However, when the rotation of the image bearing member is stopped or started, the contact between the image bearing member and the cleaning blade becomes a state that is different from the normal state. More specifically, in the normal rotation state, a frictional force based on the dynamic friction coefficient is generated between the image bearing member and the cleaning blade, but, at the start of movement of the image bearing member, there is added a frictional force based on the static friction coefficient. A shock resulting from such sudden change of the state induces "fine vibration phenomenon" of the cleaning blade. As a result, there is generated a fine gap between the image bearing member and the cleaning blade, whereby the transfer remainder toner, that is accumulated in the vicinity of the cleaning blade, temporarily passes under the cleaning blade. The transfer remainder toner, that has passed under the cleaning blade, is transferred to the intermediate transfer member, and further therefrom to the transfer material, thus eventually inducing deterioration of the quality of the formed image.

SUMMARY OF THE INVENTION

In consideration of the foregoing, the object of the present invention is to provide an image forming apparatus capable of preventing the transfer of the transfer remainder toner, that has passed under the cleaning member (cleaning blade in the foregoing description) at the start of drive of the image bearing member, eventually to the transfer material, thereby preventing the deterioration of the image quality resulting from such transfer remainder toner.

In order to achieve the above object, the present invention provides an image forming apparatus comprising: an image bearing member in which a toner image is formed on a movable surface thereof; an intermediate transfer member on which the toner image on said image bearing member is transferred; an elastic cleaning blade maintained in contact with a surface of said image bearing member, in a counter direction with respect to the moving direction of the surface of said image bearing member, for removing the toner remaining on said image bearing member after the transfer; and a contact-separation mechanism for contacting with or separating from said image bearing member and said intermediate transfer member; wherein an abut portion is defined by a portion of the surface of said image bearing member where said cleaning blade comes into contact when the main body of said image forming apparatus is stopped, said separation mechanism is adapted to separate said intermediate transfer member from said image bearing member, after the start of an image forming operation in the main body of said image forming apparatus at least until said abut portion passes through a position opposed to said intermediate transfer member.

Image forming apparatus comprising: a image bearing member having a movable surface; a charging member for charging a surface of said image bearing member to a predetermined potential; an exposure device for exposing said image bearing member after charging to form an electrostatic latent image; a developing device for attaching a toner to said electrostatic latent image to develop as a toner image; a transfer device for transferring said toner image to a transfer material; and an elastic cleaning blade maintained in contact with the surface of said image bearing member, in a counter direction with respect to the moving direction of the surface of said image bearing member, in order to remove the toner remaining on said image bearing member after the transfer; wherein an abut portion is defined by a portion of the surface of said image bearing member where said cleaning blade comes into contact with the main body of said image forming apparatus is stopped; and a DC voltage or a voltage consisting of a DC voltage superposed with an AC voltage is applied to said charging member, after the start of an image forming operation in the main body of said image forming apparatus at least until said contact portion reaches an area where said charging member executes a charging operation for the surface of said image bearing member; and a DC voltage having a polarity same as that of the voltage applied to said charging member and having an absolute value larger than the surface potential of said abut portion is applied to said transfer device at least before said contact portion reaches a contact position with said transfer device.

Image forming apparatus comprising: an image bearing member having a movable surface; a charging member for charging a surface of said image bearing member to a predetermined potential; an exposure device for exposing said image bearing member after charging to form an electrostatic latent image; a developing device for attaching a toner to said electrostatic latent image to develop as a toner image; a transfer device for transferring said toner image to a transfer material; and an elastic cleaning blade maintained in contact with the surface of said image bearing member, in a counter direction with respect to the moving direction of the surface of said image bearing member, in order to remove transfer remainder toner remaining on said image bearing member; wherein an abut portion is defined by a portion of the surface of said image bearing member where said cleaning blade comes into contact when the main body of said image forming apparatus is stopped, a DC voltage or a voltage consisting of a DC voltage superposed with an AC voltage is applied to said charging member and said contact portion is exposed to light by said exposing device, after the start of an image forming operation in the main body of said image forming apparatus at least until said contact portion reaches an area where said charging member executes a charging operation for the surface of said image bearing member; and a DC voltage having a polarity the same as that of the voltage applied to said charging member and having an absolute value larger than the surface potential of said contact portion is applied to said transfer device at least before said contact portion reaches a contact position with said transfer device.

Image forming apparatus comprising: an image bearing member in which a toner image is formed on the movable surface thereof; an intermediate transfer member on which the toner image on said image bearing member is transferred; and an elastic cleaning blade maintained in contact with the surface of said image bearing member, in a counter direction with respect to the moving direction of the surface of said image bearing member, for removing the toner remaining on said image bearing member after the transfer; wherein an abut portion is defined by a portion of the surface of said image bearing member where said cleaning blade comes into contact when the main body of said image forming apparatus is stopped, an area of said intermediate transfer member where said contact portion comes into contact for the first time after the start of an image forming operation in the main body of said image forming apparatus is outside a transfer area on said intermediate transfer member.

DETAILED DESCRIPTION OF THE PREFERRED EMBODIMENTS

Now the present invention will be explained in detail by description of preferred embodiments, with reference to the attached drawings.

Embodiment 1

Figure 1:
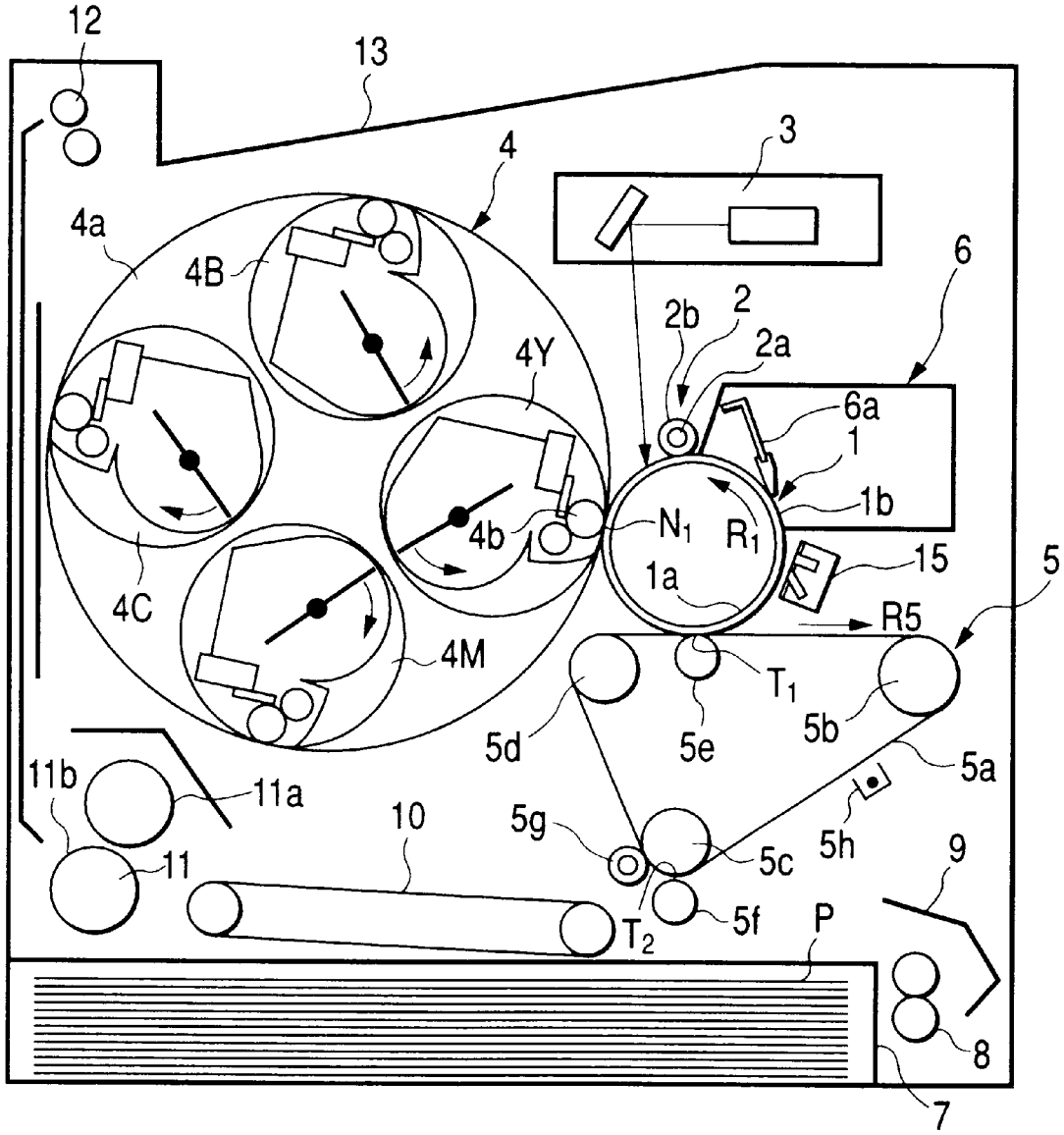
FIG. 1 is a schematic longitudinal cross-sectional view showing the configuration of an image forming apparatus constituting an embodiment 1.

The image forming apparatus shown in FIG. 1 is provided, as the image bearing member, with a drum-shaped electrophotographic photosensitive member 1 (hereinafter called "photosensitive drum"). The photosensitive drum 1 is formed by coating the external periphery (surface) of an aluminum cylinder 1*a* with a photosensitive layer 1*b* composed of an organic photosensitive coating (OPC) or amorphous silicon. The photosensitive layer 1*b* is normally insulating but becomes conductive when irradiated with the light of a specified wavelength. The photosensitive drum 1 is rotated counterclockwise (indicated by an arrow R1) by drive means (not shown).

Above the photosensitive drum 1, there is provided a charging roller (charging member) 2 for uniformly charging the surface of the photosensitive drum 1. The charging roller 2 is composed of a metal core 2*a*, covered with elastic rubber 2*b* or the like or a medium resistance. In practice, there are advantageously provided plural layers for preventing the damage to the photosensitive drum 1, such as by the flow of an excessive current or the adhesion to the photosensitive drum 1. The charging roller 2 is driven by contact with the photosensitive drum 1.

By the application of a DC bias voltage exceeding a threshold value to the metal core 2*a* of the charging roller 2, there is generated a discharge in the vicinity of the charging roller 2 and the photosensitive drum 1, whereby the photosensitive drum 1 is charged into a polarity which is the same as that of the bias voltage applied to the charging roller 2. At the bias application, a simultaneous application of an AC bias voltage allows the surface of the photosensitive drum 1 to be move uniformly charged. The peak-to-peak voltage $V_{PP}$ and the frequency of the AC bias are variable depending for example on the resistance of the charging roller 2, but are generally in a range of 1 to 3 kV and 500 to 3000 Hz respectively.

For constantly charging the surface of the photosensitive drum 1 in a uniform manner, the AC bias is preferably subjected to constant current control, with a current $I_{AC}$ in a range of 500 to 3000 $\mu$A. The DC bias is preferably negative, generally in a range from −350 to −800 V. With the charging roller 2 of the present embodiment, the surface of the photosensitive drum 1 assumes a potential approximately equal to that of the applied DC bias. The surface potential of the photosensitive drum 1 in this state is hereinafter called the "dark portion potential $V_D$".

The surface of the photosensitive drum 1, maintained at a predetermined negative potential by the charging roller 2, is irradiated, in the exposure device 3, with light based on the signal from a controller (not shown), whereby an electrostatic latent image is formed. The surface of the photosensitive drum 1 becomes electrically conductive at the position irradiated with light, whereby the absolute value of the surface potential of the photosensitive drum 1 decreases. The light source can be a semiconductor laser or an LED. The amount of irradiating light is preferably so controlled that the surface potential of the photosensitive drum 1, at the irradiated position, becomes about −50 to −250 V. The surface potential of the photosensitive drum 1 in this state is hereinafter called "light portion potential $V_L$".

Subsequently, the electrostatic latent image on the photosensitive drum 1 is developed with a yellow developing unit 4Y of the developing device 4 in the following manner. A rotary unit 4*a* rotates in such a manner that the yellow developing unit 4Y is placed at a developing position $N_1$ opposed to the photosensitive drum 1. The yellow developing unit 4Y contains yellow developer (hereinafter called toner) which is constantly charged negatively by friction with a member provided in the yellow developing unit 4Y. The negatively charged yellow toner is then coated in a thin layer on a sleeve (generally composed of a metal roller) 4*b*, which is positioned adjacent to the photosensitive drum 1 and is rotated in the forward direction with respect to the rotating direction (indicated by an arrow R1) of the photosensitive drum 1. The sleeve 4*b* is given a suitable bias (hereinafter called "developing bias") between the dark portion potential $V_D$ and the light portion potential $V_L$, whereby an electric field is generated between the photosensitive drum 1 and the sleeve 4*b* and the toner present on the sleeve 4*b* jumps, only in a portion corresponding to the light portion potential $V_L$, onto the photosensitive drum thereby achieving reversal development.

In this method, however, the toner may unnecessarily be deposited on the portion of the dark portion potential $V_D$ on the photosensitive drum 1. A simultaneously application of an AC bias to the developing bias causes the toner movement to converge by repeated reciprocation of the toner between the sleeve 4*b* and the photosensitive drum 1, thereby achieving cleaner development than in the application of the DC component only. Thus the simultaneous application of the AC bias allows to suppress the unnecessary toner deposition in the portion of the d ark portion potential $V_D$ on the photosensitive drum 1. Consequently there is ordinarily employed a DC bias to which an AC bias is added.

An intermediate transfer belt 5*a* of a transfer device 5 is so positioned as to contact the photosensitive drum 1. A positive DC bias is applied to a primary transfer roller 5*e*, positioned in contact with the rear face of the intermediate transfer belt 5*a* at a position opposed to the photosensitive drum 1, to generate an electric field at a primary transfer position $T_1$ between the photosensitive drum 1 and the primary transfer roller 5*e*, whereby, among the yellow toner deposited on the photosensitive drum 1, the toner present in such primary transfer position is subjected to a primary transfer onto the intermediate transfer belt 5*a*. The primary transfer roller 5*e* is composed of a metal core and a covering elastic member of a medium resistance (about $10^5$ to $10^{10}$ Ω). The intermediate transfer belt 5*a* is principally composed of a rubber material or a resinous material. A representative structure thereof consists of a rubber substrate coated thereon with a surfacial layer of a medium resistance. For preventing elongation or contraction, a metal core member may be embedded in the rubber layer. The intermediate transfer belt 5*a* is supported by a driving roller 5*b*, a secondary transfer counter roller 5*c* and a tension roller 5*d* with a suitable tension. Rotation of the driving roller 5*b* rotates the intermediate transfer belt 5*a* in the forward direction (indicated by an arrow R5) with respect to the photosensitive drum 1 and at a substantially same speed therewith.

In the primary transfer explained above, the toner cannot be transferred (primary transfer) by 100% from the photosensitive drum 1 to the intermediate-transfer belt 5*a*, so that a certain amount of toner remains on the surface of the photosensitive drum 1. Such primary transfer remainder toner, if left unremoved, is transferred onto the intermediate transfer belt 5*a* in the next turn of the photosensitive drum 1, thereby distorting the image. In order to prevent such phenomenon, the present embodiment is provided with a cleaning device 6, having a cleaning blade 6*a* of which end is in counter contact with the photosensitive drum 1 with respect to the rotating direction thereof thereby mechanically removing the primary transfer remainder toner from the photosensitive drum 1. In this operation, the angle between the cleaning blade 6*a* and a tangential line to the photosensitive drum 1 at the contact position thereof with the cleaning blade 6*a*, and the linear pressure thereof to the photosensitive drum 1 are preferably selected, respectively, in a range of 0° to 20° and in a range of 20 to 100 g/cm. The cleaning blade 6*a* is commonly composed of urethane rubber supported with a metal plate.

After the above-explained process, the rotary unit 4*a* rotates to bring a magenta developing unit 4M, a cyan developing unit 4C and a black developing unit 4B in succession to the developing position $N_1$ opposed to the photosensitive drum 1 to repeat similar processes with each of magenta, cyan and black toners, whereby toner images of four colors are superposed on the intermediate transfer belt 5*a*.

Then a secondary transfer roller 5*f*, opposed to the secondary transfer counter roller 5*c* across the intermediate transfer belt 5*a*, is brought into contact with the intermediate transfer belt 5*a* and is given a bias of a polarity opposite to that of the toners, and, in this state, a transfer material P such as paper is passed through a secondary transfer position $T_2$ between the intermediate transfer belt 5*a* and the secondary transfer roller 5*f*, whereby the toner images of four colors, supported on the intermediate transfer belt 5*a*, are subjected to collective secondary transfer onto the transfer material P. The transfer material P, contained in a paper feeding cassette 7, is transported by transport rollers 8 along a guide member 9 and is supplied to the secondary transfer position $T_2$ in synchronization with the toner images of four colors present on the intermediate transfer belt 5*a*. If the toners of four colors are mutually different in the amounts of charge, the transferability becomes different among the colors in the secondary transfer. Therefore, if necessary, the toners on the intermediate transfer belt 5*a* may be recharged for example with a corona charger 5*h* prior to the secondary transfer, thereby matching the amounts of charge among the toners of the different colors. The secondary transfer roller 5*f* is composed of a metal core and a covering elastic member of a medium resistance ($10^6$ to $10^{10}$ Ω·cm).

In the secondary transfer mentioned above, all the toner present on the intermediate transfer belt 5*a* is not transferred onto the transfer material P, but a part of the toner remains on the intermediate transfer belt 5*a*, as the secondary transfer remainder toner, which is removed by an intermediate transfer belt cleaning roller 5*g*. The intermediate transfer belt cleaning roller 5*g* is so positioned as to oppose to the secondary transfer counter roller 5*c* across the intermediate transfer belt 5*a*, and is brought into contact therewith simultaneously with the start of the secondary transfer and is given a positive DC bias exceeding the discharge starting threshold value, thereby positively charging the secondary transfer remained toner. The positively charged secondary transfer remainder toner is re-transferred onto the photosensitive drum 1 at the primary transfer position $T_1$ between the photosensitive drum 1 and the intermediate transfer belt 5*a*, by an electric field generated by the surface potential of the photosensitive drum 1 and the positive DC bias applied to the primary transfer roller 5*e*. The intermediate transfer belt cleaning roller 5*g* is composed of a metal core, covered with an elastic rubber layer of a medium resistance. In practice, there are preferably provided plural layers for preventing damage to the intermediate transfer belt 5*a* such as flow of excessive current or adhesion thereto.

The transfer material P bearing the secondarily transferred toner images is transported by a conveyor belt 10 to a fixing device 11, in which the toner images are surfacially fixed by the heat and pressure applied by a fixing roller 11*a* and a pressure roller 11*b*. The transfer material P after the toner image fixation is transported upwards and is discharged by discharge rollers 12 onto a discharged sheet tray 13.

In the color image forming apparatus, as the color is reproduced by superposing toners of four colors, the proper color reproduction cannot be obtained if the image density fluctuates by various conditions such as a variation in the environmental condition of use or a variation in the number of copies. In the present embodiment, therefore, a density detecting toner image (patch) is formed on the photosensitive drum 1 and the density of such patch is detected by an optical density sensor 15 positioned adjacent to the photosensitive drum 1, and image density is controlled by a feedback of the detected result on the developing bias.

Figure 2B:
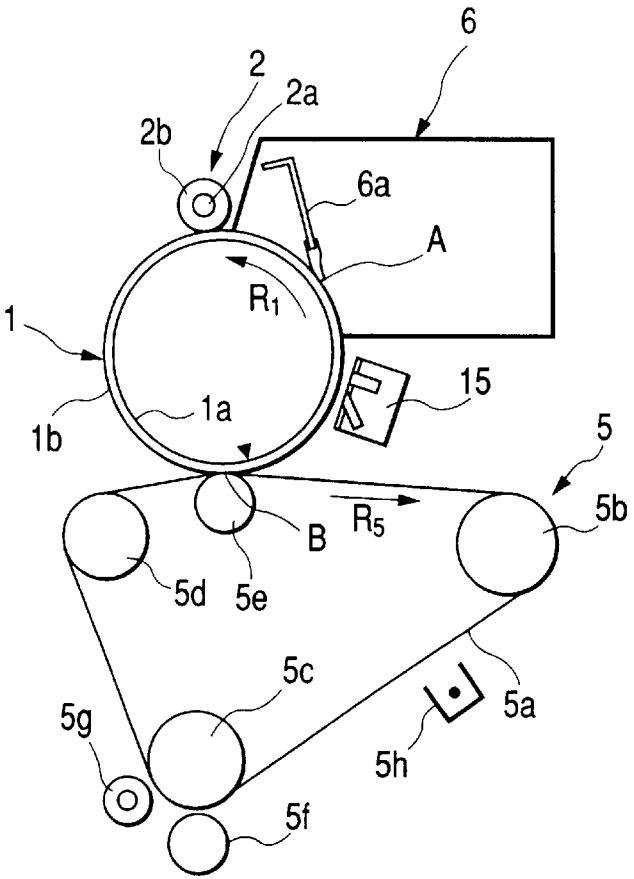
FIGS. 2A and 2B are views showing the functions of the embodiment 1.
Figure 2A:
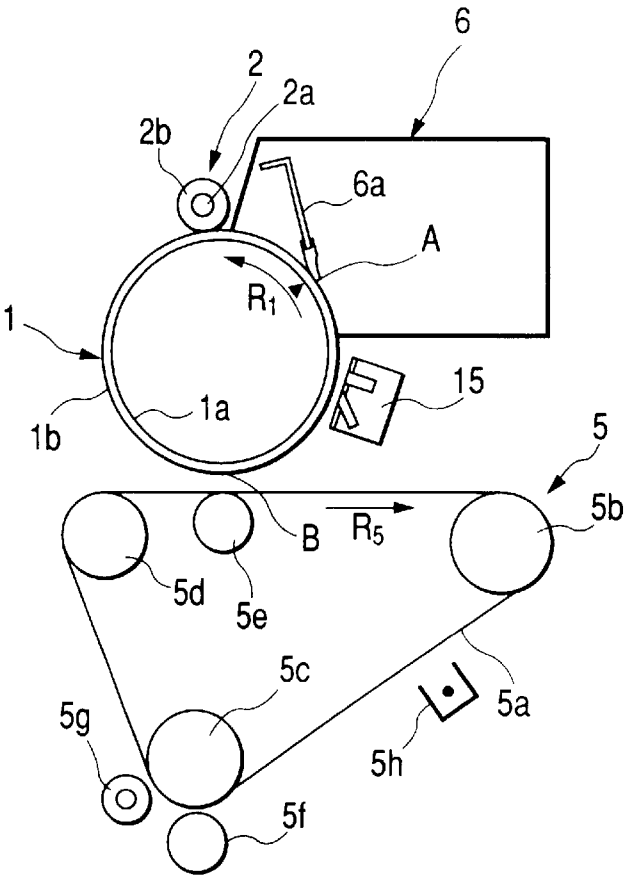

When the rotation of the photosensitive drum 1 is stopped, or started for a next image formation or for an image formation after a sheet jam elimination process, a shock resulting from a sudden change in the contact state between the photosensitive drum 1 and the cleaning blade 6*a* induces a small vibration phenomenon in the cleaning blade 6*a*. Thus, a small gap is generated between the photosensitive drum 1 and the cleaning blade 6*a* and the transfer remainder toner (indicating both the primary transfer remainder toner and the secondary transfer remained toner) accumulated in the vicinity of the cleaning blade 6*a* temporarily passes thereunder. In order to prevent the transfer of such passing remainder toner to the intermediate transfer belt 5*a* at the primary transfer position $T_1$, the present embodiment activates the transfer device 5 as shown in FIGS. 2A and 2B. More specifically, at the start-up of the main body of the image forming apparatus (hereinafter simply called "main body") and at the end of the printing operation therein, the primary transfer roller 5*e* is moved as shown in FIG. 2A in a direction away from the photosensitive drum 1 (downward in FIG. 2A) whereby the intermediate transfer belt 5*a* is separated from the photosensitive drum 1.

Then, after the start of an ordinary printing operation or a printing operation after a sheet jam removal process, the photosensitive drum 1 is rotated while it is in a state separated from the intermediate transfer belt 5*a*, and, after an abut portion A of the photosensitive drum 1 where the cleaning blade 6*a* is contact at the stopped state of the main body (hereinafter simply called "abut portion A") passes through an opposed position B to the intermediate transfer belt 5*a*, the primary transfer roller 5*e* is moved toward the photosensitive drum 1 as shown in FIG. 2B to bring the intermediate transfer belt 5*a* in contact with the photosensitive drum 1. The above-explained printing process of the image data is initiated thereafter. Otherwise, it is also possible to maintain the intermediate transfer belt 5*a* in contact with the photosensitive drum 1 at the start-up of the main body and after the end of the printing operation, and to separate the intermediate transfer belt 5*a* from the photosensitive drum 1 before the abut portion A passes through the position B opposed to the intermediate transfer belt 5*a*.

Even if the shock resulting from the sudden change at the stopping and starting of the rotation of the photosensitive drum 1 induces the small vibration phenomenon of the cleaning blade 6*a*, thereby causing the temporary passing of the transfer remained toner, the above-explained control of the main body allow to prevent the transfer of such passing remainder toner onto the intermediate transfer belt 5*a*.

Embodiment 2

Figure 3:
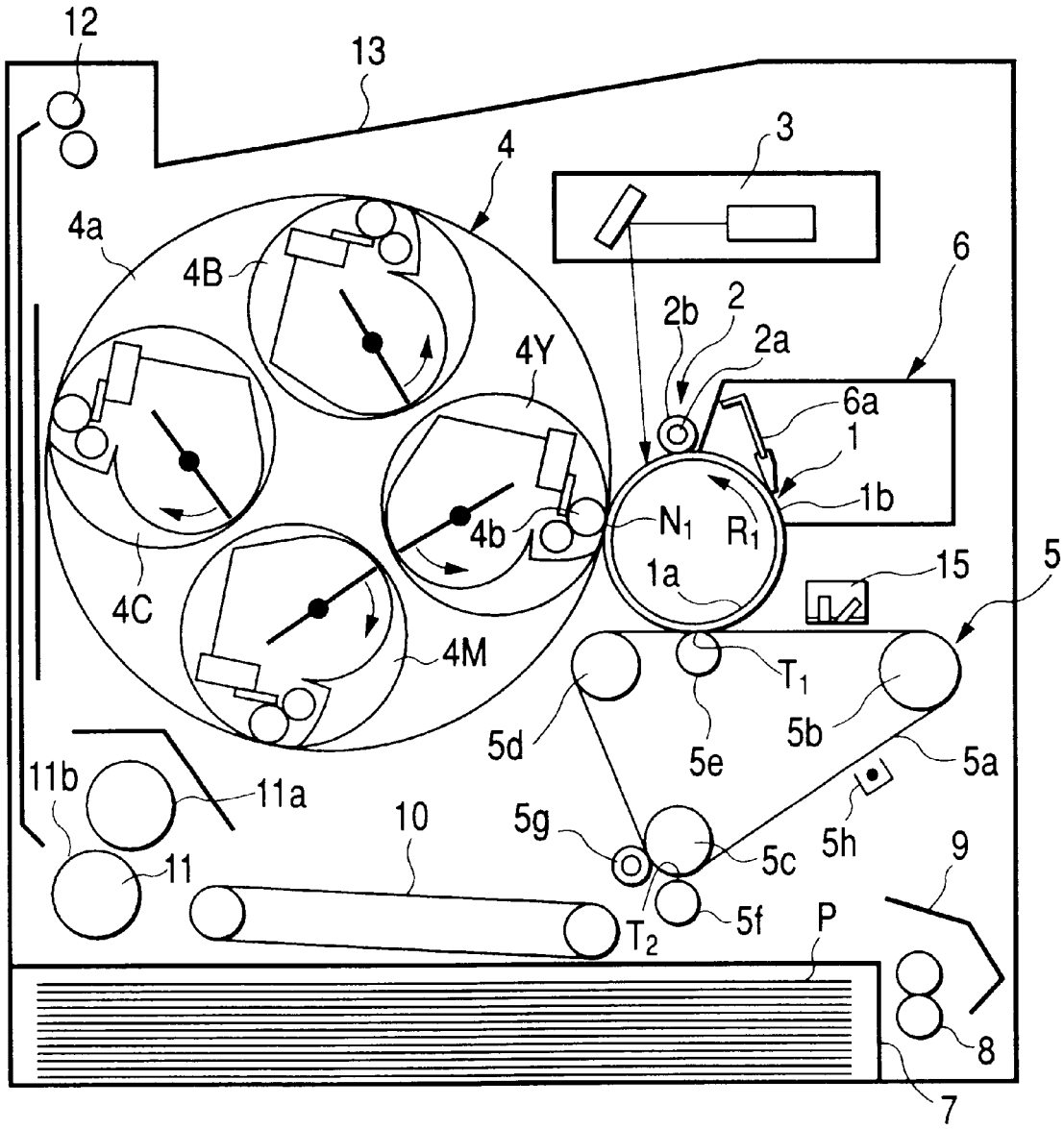
FIG. 3 is a schematic longitudinal cross-sectional view showing the configuration of an image forming apparatus constituting an embodiment 2.

In the following there will be explained, with reference to FIGS. 3, 4A and 4B, an embodiment 2 of the image forming apparatus of the present invention, in which the charging roller 2, exposure device 3, developing device 4, transfer device 5, cleaning device 6 and fixing device 11 are constructed same as in the foregoing embodiment 1.

In the present embodiment 2, the image density control is executed on the intermediate transfer belt 5*a*. Since such method can also consider the variation in density caused by the fluctuation in the primary transfer efficiency resulting for example from environmental changes, more precise density control can be achieved than on the photosensitive drum 1.

In the present embodiment 2, different from the embodiment 1, the mechanism for separating the intermediate transfer belt 5*a* from the photosensitive drum 1 is not required, as will be explained in the following.

Figure 4B:
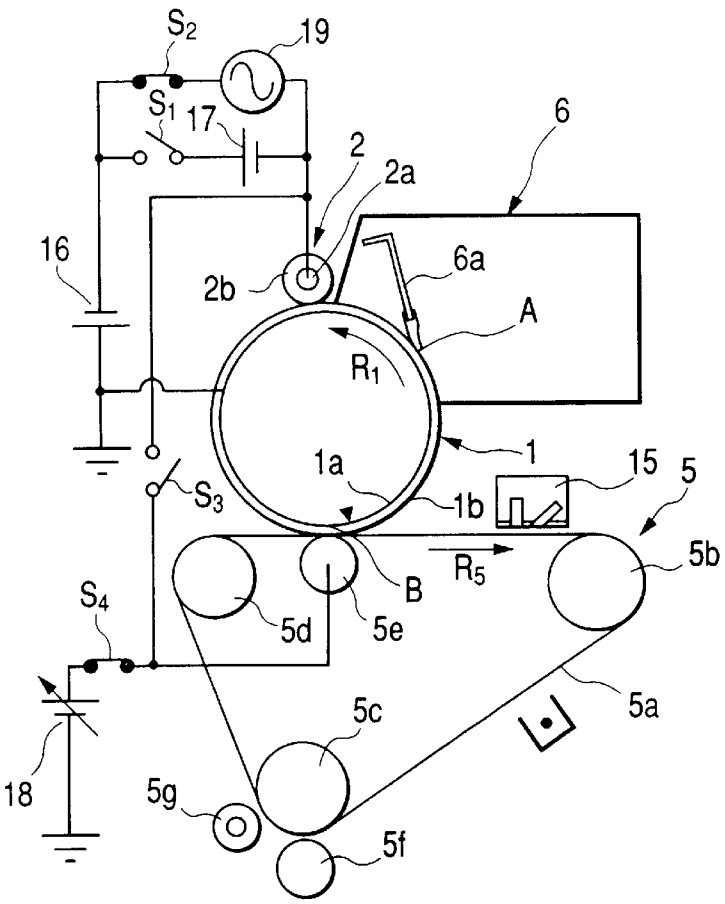
FIGS. 4A and 4B are views showing the functions of the embodiment 2.
Figure 4A:
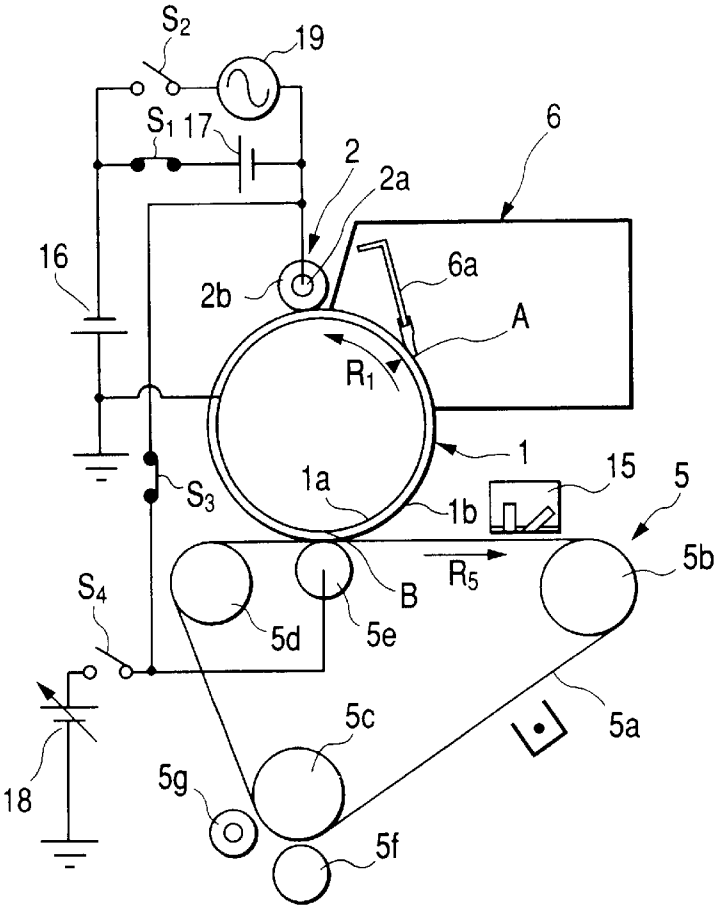

In this embodiment, the main body functions as shown in FIGS. 4A and 4B, in order to prevent the transfer, onto the intermediate transfer belt 5*a*, of the transfer remainder toner that has temporarily passed under the cleaning blade 6*a* by the small vibration phenomenon thereof induced by the shock at the stopping or start of the rotation of the photosensitive drum 1. After the printing operation is started and the rotation of the photosensitive drum 1 is started, a switch $S_1$ is turned on while a switch $S_2$ is turned of f before the abut portion A reaches the discharge area of the charging roller 2, thereby supplying the charging roller 2 with a negative high DC voltage 16, 17 (about −0.8 to −1.5 kV) exceeding the discharge starting voltage and thus charging the passed remainder toner. Also, before the abut portion A reaches a contact portion B between the photosensitive drum 1 and the intermediate transfer belt 5*a*, a switch $S_3$ is turned on while a switch $S_4$ is turned off to supply the primary transfer roller 5*e* with a negative high DC voltage 16, 17 (about −0.6 to −1.3 kV) larger than the surface potential of the abut portion A.

Consequently an electric field is generated at the contact position B between the photosensitive drum 1 and the intermediate transfer belt 5*a*, and the passed remainder toner thus charged receives an attracting electrostatic force toward the photosensitive drum 1. Then, after the abut portion A has passed the contact position B with the intermediate transfer belt 5*a*, the switches $S_1$, $S_3$ are turned off while the switches $S_2$, $S_4$ are turned on to initiate the ordinary printing process for the image data. There is also shown an AC power source 19.

In case the charging roller 2 is given a high DC voltage only, the photosensitive drum 1 is not charged by a portion of such voltage corresponding to the discharge starting voltage, so that the surface potential of the photosensitive drum 1 is always lower than the high DC voltage applied to the charging roller 2. Consequently, even if the high DC voltage applied to the primary transfer roller 5*e* is made the same as the high DC voltage applied to the charging roller 2, there can be satisfied the aforementioned condition (absolute value of the high DC voltage applied to the primary transfer roller 5*e* is larger than surface potential of photosensitive drum 1). Therefore, there may be employed a configuration in which, as explained above, the high DC voltage applied to the primary transfer roller 5*e* is made the same as that applied to the charging roller 2.

Also in a system not provided with the mechanism for separating the intermediate transfer belt 5*a* from the photosensitive drum 1, in case the transfer remainder toner temporarily passes under the cleaning blade 6*a* by the small vibration thereof for example induced by the shock resulting from the sudden change at the stopping or the start of rotation of the photosensitive drum 1, the above-explained control of the main body allows to prevent the transfer of such passed remainder toner onto the intermediate transfer belt 5*a*. This is because such remainder toner is retained on the photosensitive drum 1 by an electrical force at the primary transfer position $T_1$ between the photosensitive drum 1 and the intermediate transfer belt 5*a*.

Embodiment 3

In the following there will be explained, with reference to FIGS. 5A and 5B, an embodiment 3 of the image forming apparatus of the present invention, in which the charging roller 2, exposure device 3, developing device 4, transfer device 5, cleaning device 6 and fixing device 11 are constructed the same as in the foregoing embodiment 2.

Figure 5B:
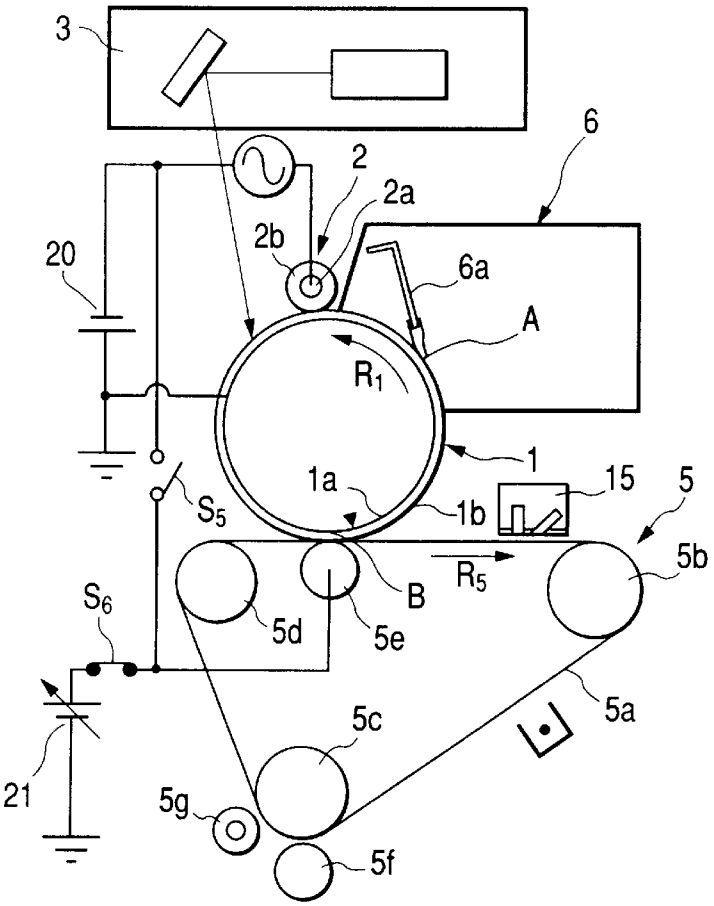
FIGS. 5A and 5B are views showing the functions of an embodiment 3.
Figure 5A:
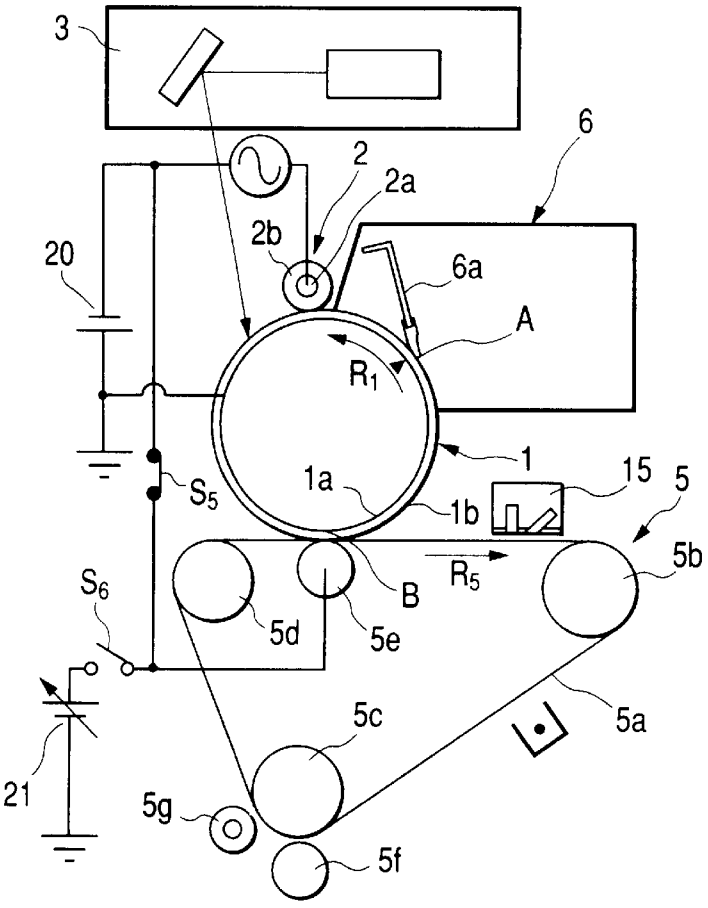

In this embodiment, the main body functions as shown in FIGS. 5A and 5B, in order to prevent the transfer, onto the intermediate transfer belt 5*a*, of the transfer remainder toner that has temporarily passed under the cleaning blade 6*a* by the small vibration phenomenon thereof induced by the shock at the stopping or start of the rotation of the photosensitive drum 1. After the printing operation is started and the rotation of the photosensitive drum 1 is started, the charging roller 2 is given a high AC voltage and a high DC voltage 20 (of which both the maximum and minimum values exceed the discharge starting voltage), thereby uniformly charging the passed remainder toner, before the contact portion a reaches the discharge area of the charging roller 2. The overlapping of an AC component realizes more uniform charging of the toner, than with the DC component only.

In order to suppress the variation by the environmental conditions, the AC component is preferably constant-current controlled. Preferably, the AC current $I_{AC}$ and the frequency in such state are respectively about 500 to 3000 $\mu$A and about 500 to 3000 Hz, and the DC component is about −350 to −800 V. Also the abut portion A is exposed by the exposure device 3 to reduce the surface potential of the abut portion A (−50 to −250 V). Furthermore, before the abut portion A reaches a contact position B between the photosensitive drum 1 and the intermediate transfer belt 5*a*, a switch $S_5$ is turned on while a switch $S_6$ is turned off as shown in FIG. 5A to supply the primary transfer roller 5*e* with a negative high DC voltage 20 larger than the surface potential of the abut portion A. Since the surface potential of the photosensitive drum 1 is reduced (−50 to −250 V) by the laser exposure, the voltage applied to the primary transfer roller 5*e* need not be so large (about −300 to −700 V). Consequently an electric field is generated at the contact position B between the photosensitive drum 1 and the intermediate transfer belt 5*a*, and the passed remainder toner thus charged receives an attracting electrostatic force toward the photosensitive drum 1. Then, after the abut portion A has passed the contact position B with the intermediate transfer belt 5*a*, the switches $S_5$ is turned off while the switches $S_6$ is turned on as shown in FIG. 5B to initiate the ordinary printing process for the image data.

As the surface potential of the photosensitive drum 1 is reduced by the laser exposure, the surface potential of the photosensitive drum 1 is always lower than the high DC voltage applied to the charging roller 2. Consequently, as explained in the foregoing, the high DC voltage applied to the primary transfer roller 5*e* may be made same as the high DC voltage applied to the charging roller 2. Stated differently, without the laser exposure, the surface potential of the photosensitive drum 1 becomes approximately equal to the high DC voltage applied to the primary transfer roller 5*e*, so that the high DC voltage applied thereto cannot be made same as that applied to the charging roller 2.

Also in a system not provided with the mechanism for separating the intermediate transfer belt 5*a* from the photosensitive drum 1, in case the transfer remainder toner temporarily passes under the cleaning blade 6*a* by the small vibration thereof for example induced by the shock resulting from the sudden change at the stopping or the start of rotation of the photosensitive drum 1, the above-explained control of the main body allows to prevent the transfer of such passed remainder toner onto the intermediate transfer belt 5*a*. This is because such remainder toner charged uniformly is retained on the photosensitive drum 1 by an electrical force at the primary transfer pesition $T_1$ between the photosensitive drum 1 and the intermediate transfer belt 5*a*. The present embodiment 3 allows to charge the toner with more uniformly than in the embodiment 2, and therefore provides a larger effect, than in the embodiment 2, of preventing the transfer of the passed remainder toner onto the intermediate transfer belt 5*a*. Also in case the voltage applied to the primary transfer roller 5*e* cannot be made same as the high voltage applied to the charging roller 2 for example because of noise generation, the voltage applied to the primary transfer roller 5*e* can be lower than that in the embodiment 2, so that the present embodiment 3 has an advantage of reducing the cost of the high voltage source.

Embodiment 4

Figure 6B:
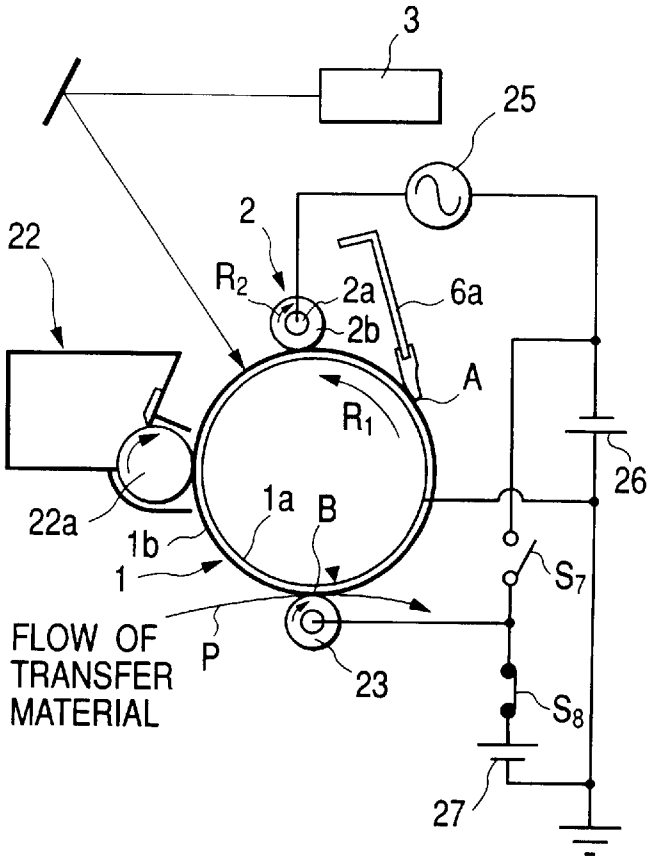
FIGS. 6A and 6B are views showing the functions of an embodiment 4.
Figure 6A:
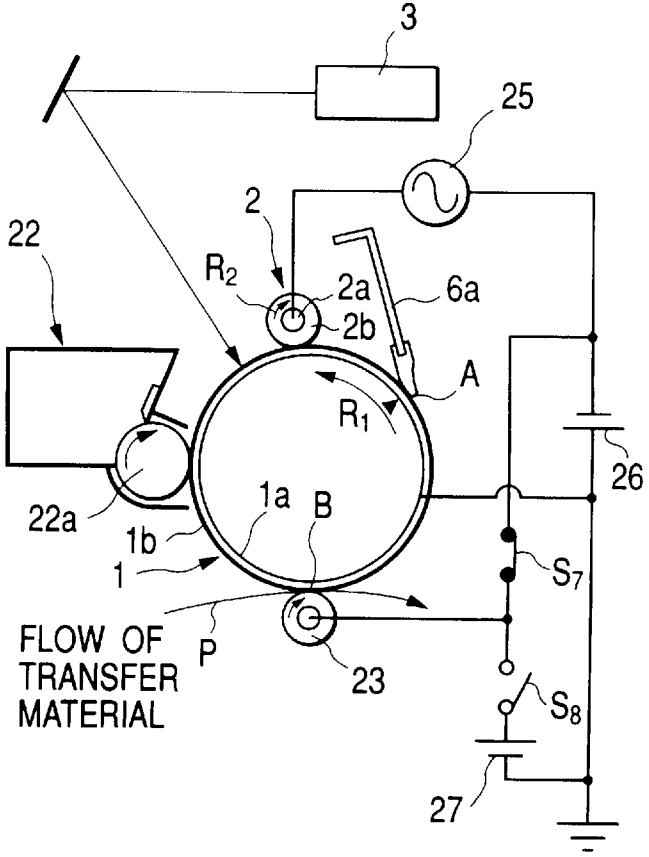

In the following there will be explained, with reference to FIGS. 6A and 6B, an embodiment 4 of the image forming apparatus (monochromatic image forming apparatus) of the present invention, in which the charging roller 2, exposure device 3, and cleaning device 6 are constructed the same as in the foregoing embodiment 1. In FIGS. 6A and 6B, 22 indicates a developing device, and 22*a* indicates a developing sleeve.

In the monochromatic image forming apparatus, the electrostatic latent image on the photosensitive drum 1 is developed with black color only, in a similar manner as in the embodiment 1. The toner image formed on the photosensitive drum 1 is transferred, without utilizing the intermediate transfer belt, directly onto the transfer material P. The transfer roller 23 is maintained in contact with the photosensitive drum 1 and is rotated at a substantially same speed, in the forward direction (clockwise) with respect to the photosensitive drum 1. The transfer roller 23 is given a positive DC bias which is opposite in polarity to the toner, and, in this state, the transfer material P is passed between the photosensitive drum 1 and the transfer roller 23, whereby, by an electric field generated therebetween, the negatively charged toner supported on the photosensitive drum 1 can be transferred onto the transfer material P.

In case the transfer remained toner temporarily passes under the cleaning blade 6*a* by the small vibration thereof induced by the shock resulting from the sudden change at the stopping or the start of rotation of the photosensitive drum 1, in order to prevent the transfer of such passed remainder toner onto the transfer roller 23 and the resulting smear of the rear face of the transfer material P, the main body in the present embodiment 4 is operated as shown in FIGS. 6A and 6B. After the printing operation is started and the rotation of the photosensitive drum 1 is started, the charging roller 2 is given a high AC voltage 25 and a high DC voltage 26 (of which both the maximum and minimum values exceed the discharge starting voltage), thereby uniformly charging the passed remainder toner, before the abut portion A reaches the discharge area of the charging roller 2.

The overlapping of an AC component realizes more uniform charging of the toner, than with the DC component only. In order to suppress the variation by the environmental conditions, the AC component is preferably constant-current controlled. Preferably, the AC current $I_{AC}$ and the frequency in such state are respectively about 500 to 3000 $\mu$A and about 500 to 3000 Hz, and the DC component is about −350 to −800 V. Also the abut portion A is exposed by the exposure device 3 to reduce the surface potential of the abut portion A (−50 to −250 V). Furthermore, before the abut portion A reaches the contact position B between the photosensitive drum 1 and the transfer roller 23, a switch $S_7$ is turned on while a switch $S_8$ is turned off as shown in FIG. 6A to supply the transfer roller 23 with a negative high DC voltage 26 larger than the surface potential of the abut portion A. Since the surface potential of the photosensitive drum 1 is reduced (−50 to −250 V) by the laser exposure, the voltage applied to the primary transfer roller 5*e* need not be so large (about −300 to −700 V). Consequently an electric field is generated at the contact position B between the photosensitive drum 1 and the transfer roller 23, and the passed remainder toner thus charged receives an attracting electrostatic force toward the photosensitive drum 1. Then, after the abut portion A has passed the contact position B with the transfer roller 23, the switches $S_7$ is turned off while the switches $S_8$ is turned on as shown in FIG. 6B to initiate the ordinary printing process for the image data.

As the surface potential of the photosensitive drum 1 is reduced by the laser exposure, it is always lower than the high DC voltage applied to the charging roller 2. Consequently, as explained in the foregoing, the high DC voltage applied to the transfer roller 23 may be made same as the high DC voltage applied to the charging roller 2. Stated differently, without the laser exposure, the surface potential of the photosensitive drum 1 becomes approximately equal to the high DC voltage applied to the charging roller 2, so that the high DC voltage applied to the transfer roller 23 cannot be made the same as that applied to the charging roller 2.

In the monochromatic image forming apparatus which is ordinarily not provided with the mechanism for separating the transfer roller 23 from the photosensitive drum 1, in case the transfer remained toner temporarily passes under the cleaning blade 6*a* by the small vibration thereof for example induced by the shock resulting from the sudden change at the stopping or the start of rotation of the photosensitive drum 1, the above-explained control of the main body allows the prevention of the transfer of such passed remainder toner onto the transfer roller 23 and to prevent the resulting smear on the rear face of the transfer material P. This is because such remainder toner charged uniformly is retained on the photosensitive drum 1 by an electrical force at the transfer position between the photosensitive drum 1 and the transfer roller 23.

Embodiment 5

In the following there will be explained, with reference to FIGS. 7 and 8A to 8C, an embodiment 5 of the image forming apparatus of the present invention, in which the charging roller 2, exposure device 3, developing device 4, transfer device 5, cleaning device 6, fixing device 11 and the density control method are same as in the foregoing embodiments 2 and 3. In the present embodiment 5, the photosensitive drum 1 and the driving roller 5*b* for driving the intermediate transfer belt 5*a* are driven by a same motor.

Figure 8A:
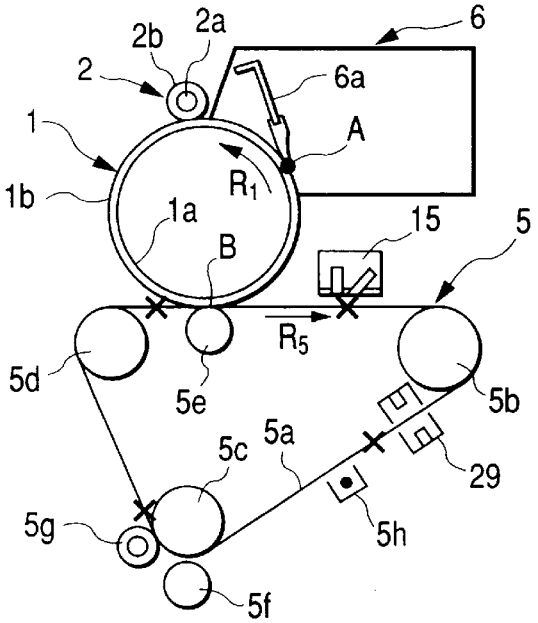
FIGS. 8A, 8B and 8C are views showing the functions of the embodiment 5.
Figure 8B:
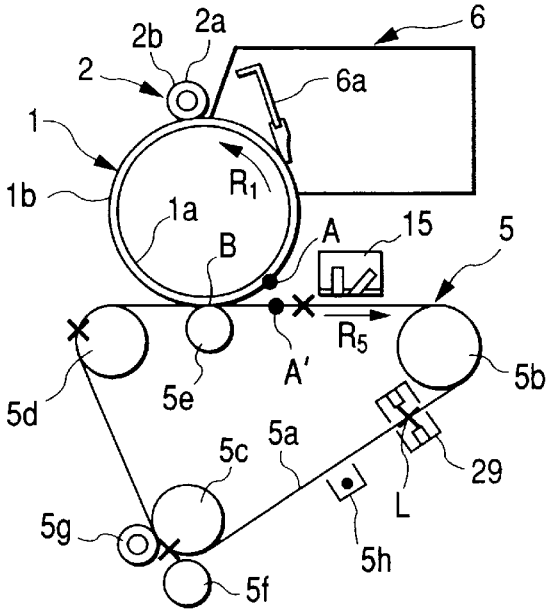
Figure 8C:
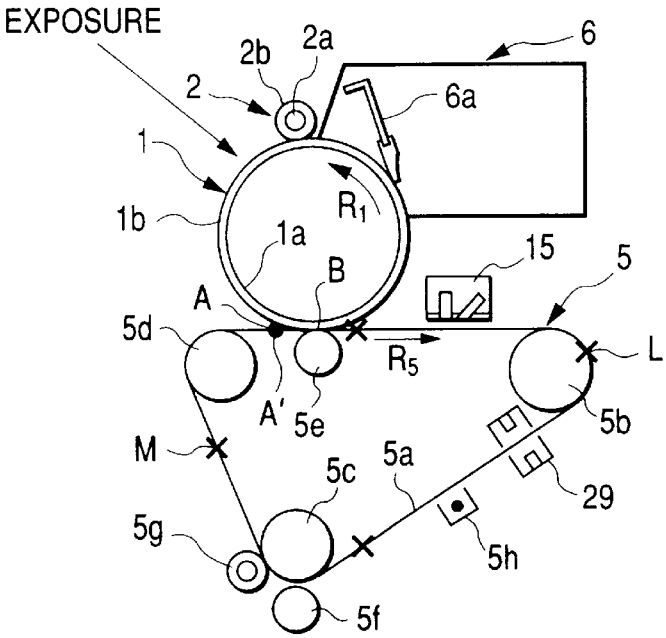

In this embodiment, the main body functions as shown in FIGS. 8A to 8C, in order to prevent the transfer, onto the intermediate transfer belt 5*a*, of the transfer remainder toner that has temporarily passed under the cleaning blade 6*a* by the small vibration phenomenon thereof induced by the shock at the stopping or start of the rotation of the photosensitive drum 1. For this purpose, the intermediate transfer belt 5*a* is provided with a top sensor 29 to be explained later, as the mechanism for detecting a top signal indicating the top end position of the formed image. The intermediate transfer belt 5*a* is provided, at a constant interval along the periphery thereof, with small rectangular holes (hereinafter called "end holes"), at either lateral end portion (outside the longitudinal side of the largest usable transfer material) with respect to the moving direction (indicated by an arrow R5) of the intermediate transfer belt 5*a*. Also in the main body, there are provided an LED (light emitting element) and a photosensor element in positions corresponding to the end holes and across the intermediate transfer belt 5*a*. When the printing operation is started and the rotation of the intermediate transfer belt 5*a* is started, the LED is activated and the light therefrom is detected by the photosensitive element. The detection of the LED light constitutes the detection of the top signal, namely the front end position of the image. In FIGS. 8A to 8C, a black dot (·) indicates the contact position between the photosensitive drum 1 and the cleaning blade 6*a* when the operation of the main body is stopped, or a position on the intermediate transfer belt where the contact position comes into contact for the first time after the start of rotation. Also a mark "x" indicates the position of the end hole in the intermediate transfer belt 5*a*.

It is assumed that the intermediate transfer belt 5*a* has a peripheral length X, while the largest usable transfer material has a length Y, and K indicates a maximum value which does not exceed (X−Y) and of which an integral multiple is equal to X. In the present embodiment 5, the intermediate transfer belt 5*a* is provided, in the end portion thereof, with end holes for detecting the top signal with an interval K. As a specific example, in case the intermediate transfer belt 5*a* has a peripheral length of 440 mm and the largest usable transfer material is of A4 size (297 mm in length), the end holes for detecting the top signal are formed with an interval of 110 mm.

In the following there will be explained the specific configuration of the present embodiment. In response to a signal from the controller, the printing operation is initiated, and the photosensitive drum 1 and the driving roller 5*b* start to rotate. A time T is defined from the start of rotation of the photosensitive drum 1 to the arrival of the abut portion A at the contact position between the photosensitive drum 1 and the intermediate transfer belt 5*b*, and a position of the intermediate transfer belt 5*a* at the initial detection of the top signal by the top sensor 29 after the lapse of the time T is defined as a reference position L.

Also the position of an end hole of the intermediate transfer belt 5*a*, that passes for the first time the contact position B between the photosensitive drum 1 and the intermediate transfer belt 5*a*, after the passing of the reference position L through a position of the top sensor 29, is defined as an image start position M. The image start position M can in fact be specified the number of end holes that have passed the position of the top sensor 29 after the passing of the reference position L through the above-mentioned position of the top sensor 29. Such number varies depending on the number of the end holes and the position of the top sensor 29 in the main body.

Figure 7:
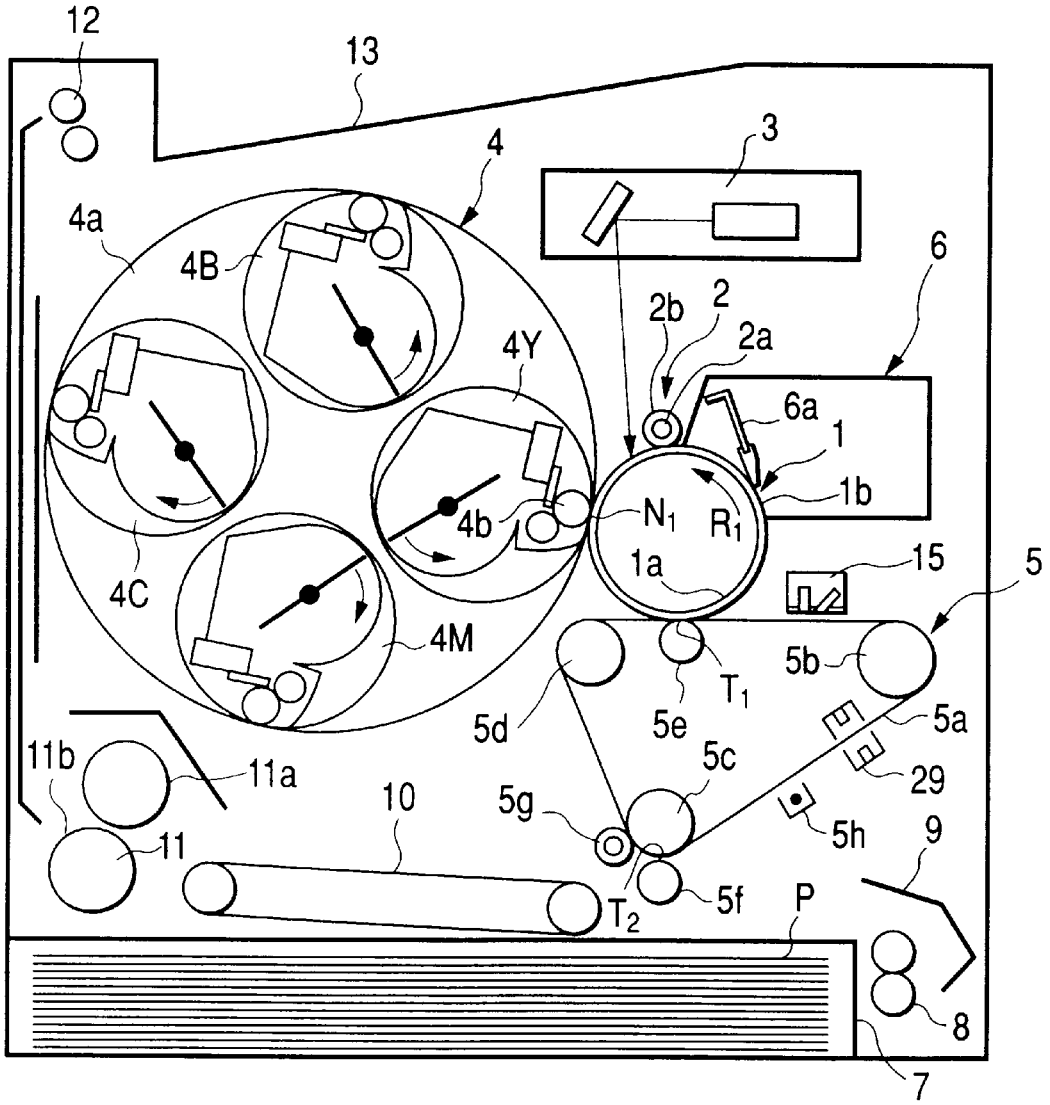
FIG. 7 is a schematic longitudinal cross-sectional view showing the configuration of an image forming apparatus constituting an embodiment 5.

In case the intermediate transfer belt 5*a* has a peripheral length of 440 mm, the largest usable transfer materials of A4 size (297 mm in length) and the top sensor 29 is in a position illustrated in FIG. 7, the end holes for detecting the top signal are provided at an interval of 110 mm so that there are provided four end holes. In such case, the image start position M corresponds to the second end hole, counting from the reference position L. The image printing operation is so started that the image is started from a position corresponding to the image start position M. More specifically, the image start position M corresponds to the top end of the transfer material P. The above-explained situation can be attained in the present embodiment 5, by such control as to initiate the laser exposure after a predetermined time from the passing of the image start position M through the position of the top sensor 29.

In the above-explained configuration, a position A' of the intermediate transfer belt 5*a*, corresponding to the first contact point of the abut portion A with the intermediate transfer belt 5*a*, is always in a non-image area.

In a system not provided with the mechanism for separating the intermediate transfer belt 5*a* from the photosensitive drum 1, in case the transfer remainder toner temporarily passes under the cleaning blade 6*a* by the small vibration thereof induced by the shock resulting from the sudden change at the stopping or the start of rotation of the photosensitive drum 1, the above-explained control of the main body causes such passed remainder toner to be transferred only onto the non-image area of the intermediate transfer belt 5*a*, thereby preventing the transfer of such toner onto the transfer material P. Such transfer remainder toner, transferred onto the non-image area of the intermediate transfer belt 5*a*, is recharged by the intermediate transfer belt cleaning roller 5*g* after the printing operation is terminated, and is recovered onto the photosensitive drum 1. In the present embodiment 5, since the image area of the intermediate transfer belt 5*a* does not come into contact with the passed remainder toner, the transfer of such passed remainder toner can be more securely prevented than in the embodiment 3.

The foregoing embodiments 1, 2, 3 and 5 employ the intermediate transfer member of a belt shape, but the present invention is not limited to such embodiments and can also employ for example a drum-shaped intermediate transfer member. Also in such case the basic configuration of the image forming apparatus can be substantially same as that in the above-mentioned embodiments and there can be anticipated substantially similar effects.

As explained in the foregoing, the present invention allows, in case the transfer remainder toner temporarily passes under the cleaning blade by the small vibration thereof induced by the shock resulting from the sudden change at the stopping or start of rotation of the photosensitive drum, to prevent the transfer of such transfer remainder toner onto the intermediate transfer member or the transfer material.

What is claimed is:

1. An image forming apparatus having a main body, said image forming apparatus comprising:

an image bearing member on which a toner image is formed on a movable surface thereof;

an intermediate transfer member on which the toner image on said image bearing member is transferred;

an elastic cleaning blade for removing the toner remaining on said image bearing member after the transfer; and a contact-separation mechanism for contacting with or separating from said image bearing member and said intermediate transfer member;

wherein an abut portion is defined by a portion of the surface of said image bearing member with which said cleaning blade comes into contact when the main body of said image forming apparatus is stopped, and wherein, after a start of an image forming operation in the main body of said image forming apparatus and until at least said abut portion passes through a position opposed to said intermediate transfer member, said contact-separation mechanism separates said intermediate transfer member from said image bearing member.

2. The image forming apparatus according to claim 1, wherein the start of said image forming operation means the start of a new image forming process.

3. The image forming apparatus according to claim 1, wherein the start of said image forming operation means the start of an image forming process after a jam removal.

4. An image forming apparatus having a main body, said image forming apparatus comprising:

an image bearing member having a movable surface;

a charging member for charging a surface of said image bearing member to a predetermined potential;

an exposure device for exposing said image bearing member after charging to form an electrostatic latent image;

a developing device for attaching a toner to said electrostatic latent image to develop as a toner image;

a transfer device for transferring said toner image to a transfer material; and an elastic cleaning blade for removing the toner remaining on said image bearing member after the transfer;

wherein an abut portion is defined by a portion of the surface of said image bearing member with which said cleaning blade comes into contact when the main body of said image forming apparatus is stopped, wherein, after a start of an image forming operation in the main body of said image forming apparatus and before at least said abut portion reaches an area in which said charging member executes a charging operation for the surface of said image bearing member, a DC voltage or a voltage consisting of a DC voltage superposed with an AC voltage is applied to said charging member; and, wherein, before at least said abut portion reaches a contact position in which said abut portion is in contact with said transfer device, a DC voltage having a polarity, which is the same as that of the voltage applied to said charging member and having an absolute value larger than a surface potential of said abut portion is applied to said transfer device.

5. The image forming apparatus according to claim 4, wherein the start of said image forming operation means the start of a new image forming process.

6. The image forming apparatus according to claim 4, wherein the start of said image forming operation means the start of an image forming process after a jam removal.

7. The image forming apparatus according to claim 4, wherein said charging member is an electrode member in contact with said image bearing member.

8. The image forming apparatus according to claim 7, wherein, between said charging member and said image bearing member, there is applied, in a period after the start of said image forming operation, an electric field which prevents a deposition of the toner, that has passed the cleaning blade, onto the charging member.

9. An image forming apparatus having a main body, said image forming apparatus comprising:

an image bearing member having a movable surface;

a charging member for charging a surface of said image bearing member to a predetermined potential;

an exposure device for exposing said image bearing member after charging to form an electrostatic latent image;

a developing device for attaching a toner to said electrostatic latent image to develop as a toner image;

a transfer device for transferring said toner image to a transfer material; and an elastic cleaning blade for removing the toner remaining on said image bearing member after the transfer, wherein an abut portion is defined by a portion of the surface of said image bearing member with which said cleaning blade comes into contact when the main body of said image forming apparatus is stopped, wherein, after a start of an image forming operation in the main body of said image forming apparatus and before at least said abut portion reaches an area in which said charging member executes a charging operation for the surface of said image bearing member, a DC voltage or a voltage consisting of a DC voltage superposed with an AC voltage is applied to said charging member, wherein said abut portion is exposed to light by said exposing device, and wherein, before at least said abut portion reaches a contact position in which said abut portion is in contact with said transfer device, a DC voltage having a polarity, which is the same as that of the voltage applied to said charging member is applied to said transfer device.

10. The image forming apparatus according to claim 9, wherein the start of said image forming operation means the start of a new image forming process.

11. The image forming apparatus according to claim 9, wherein the start of said image forming operation means the start of an image forming process after a jam removal.

12. The image forming apparatus according to claim 9, wherein said charging member is an electrode member in contact with said image bearing member.

13. The image forming apparatus according to claim 12, wherein, between said charging member and said image bearing member, there is applied, in a period after the start of said image forming operation, an electric field which prevents a deposition of the toner, that has passed the cleaning blade, onto the charging member.

14. An image forming apparatus having a main body, said image forming apparatus comprising:

an image bearing member in which a toner image is formed on a movable surface thereof;

an intermediate transfer member on which the toner image on said image bearing member is transferred; and an elastic cleaning blade for removing the toner remaining on said image bearing member after the transfer, wherein an abut portion is defined by a portion of the surface of said image bearing member with which said cleaning blade comes into contact when the main body of said image forming apparatus is stopped, and wherein an area of said intermediate transfer member with which said abut portion comes into contact for a first time after a start of an image forming operation in the main body of said image forming apparatus is outside a transfer area on said intermediate transfer member.

15. The image forming apparatus according to claim 14, wherein the start of said image forming operation correspond to a start of a new image forming process.

16. The image forming apparatus according to claim 14, wherein the start of said image forming operation means the start of an image forming process after a jam removal.

17. The image forming apparatus according to claim 14, wherein, between said intermediate transfer member and said image bearing member, there is applied, in a period after the start of said image forming operation, an electric field which prevents deposition of the toner, that has passed the cleaning blade, onto a charging member.

18. An image forming apparatus having a main body, said image forming apparatus comprising:

an image bearing member having a movable surface;

a charging member for charging a surface of said image bearing member to a predetermined potential;

an exposure device for exposing said image bearing member after charging to form an electrostatic latent image;

a developing device for attaching a toner to said electrostatic latent image to develop as a toner image;

an intermediate transfer member on which the toner image on said image bearing member is transferred;

a transfer device for transferring said toner image to a transfer material; and an elastic cleaning blade for removing the toner remaining on said image bearing member after the transfer;

wherein an abut portion is defined by a portion of the surface of said image bearing member with which said cleaning blade comes into contact when the main body of said image forming apparatus is stopped, wherein, after a start of an image forming operation in the main body of said image forming apparatus and before at least said abut portion reaches an area in which said charging member executes a charging operation for the surface of said image bearing member, a DC voltage or a voltage consisting of a DC voltage superposed with an AC voltage is applied to said charging member, wherein, before at least said abut portion reaches a contact position in which said abut portion is in contact with said transfer device, a DC voltage having a polarity, which is the same as that of the voltage applied to said charging member and having an absolute value larger than a surface potential of said abut portion is applied to said transfer device, and wherein an area of said intermediate transfer member with which said abut portion comes into contact for a first time after a start of an image forming operation in the main body of said image forming apparatus is outside a transfer area on said intermediate transfer member.

19. The image forming apparatus according to claim 18, wherein the start of said image forming operation means the start of a new image forming process.

20. The image forming apparatus according to claim 18, wherein the start of said image forming operation means the start of an image forming process after a jam removal.

21. The image forming apparatus according to claim 18, wherein said charging member is an electrode member in contact with said image bearing member.

22. The image forming apparat us according to claim 21, wherein, between said charging member and said image bearing member, there is applied, in period after the start of said image forming operation, an electric field which prevents deposition of the toner, that has passed the cleaning blade, onto the charging member.

23. The image forming apparatus according to claim 18, wherein, between said intermediate transfer member and said image bearing member, there is applied, in a period after the start of said image forming operation, an electric field which prevents deposition of the toner, that has passed the cleaning blade, onto the charging member.

24. An image forming apparatus having a main body, said image forming apparatus comprising:

an image bearing member having a movable surface;

a charging member for charging a surface of said image bearing member to a predetermined potential;

an exposure device for exposing said image bearing member after charging to form an electrostatic latent image;

a developing device for attaching a toner to said electrostatic latent image to develop as a toner image;

an intermediate transfer member on which the toner image on said image bearing member is transferred;

a transfer device for transferring said toner image to a transfer material; and an elastic cleaning blade for removing the toner remaining on said image bearing member after the transfer;

wherein an abut portion is defined by a portion of the surface of said image bearing member with which said cleaning blade comes into contact when the main body of said image forming apparatus is stopped, wherein, after a start of an image forming operation in the main body of said image forming apparatus and before at least said abut portion reaches an area in which said charging member executes a charging operation for the surface of said image bearing member, a DC voltage or a voltage consisting of a DC voltage superposed with an AC voltage is applied to said charging member, wherein said abut portion is exposed to light by said exposure device, wherein, before at least said abut portion reaches a contact position in which said abut portion is in contact with said transfer device, a DC voltage having a polarity, which is the same as that of the voltage applied to said charging member is applied to said transfer device, and wherein an area of said intermediate transfer member with which said abut portion comes into contact for a first time after a start of an image forming operation in the main body of said image forming apparatus is outside a transfer area on said intermediate transfer member.

25. The image forming apparatus according to claim 24, wherein said charging member is an electrode member in contact with said image bearing member.

26. The image forming apparatus according to claim 24, wherein, between said charging member and said image bearing member, there is applied, in a period after the start of said image forming operation, an electric field which prevents a deposition of the toner, that has passed the cleaning blade, onto the charging member.

27. The image forming apparatus according to claim 24, wherein, between said intermediate transfer member and said image bearing member, there is applied, in a period after the start of said image forming operation, an electric field which prevents a deposition of the toner, that has passed the cleaning blade, onto the charging member.

28. An image forming apparatus according to claim 1, wherein said elastic cleaning blade is in contact with the surface of said image bearing member in a counter direction with respect to a moving direction of the surface of said image bearing member.

29. An image forming apparatus according to claim 4, wherein said elastic cleaning blade is in contact with the surface of asid image bearing member in a counter direction with respect to a moving direction of the surface of said image bearing member.

30. An image forming apparatus according to claim 9, wherein said elastic cleaning blade is in contact with the surface of said image bearing member in a counter direction with respect to a moving direction of the surface of said image bearing member.

31. An image forming apparatus according to claim 14, wherein said elastic cleaning blade is in contact with the surface of said image bearing member in a counter direction with respect to a moving direction of the surface of said image bearing member.

32. An image forming apparatus according to claim 18, wherein said elastic cleaning blade is in contact with the surface of said image bearing member in a counter direction with respect to a moving direction of the surface of asid image bearing member.

33. An image forming apparatus according to claim 24, wherein said elastic cleaning blade is in contact with the surface of said image bearing member in a counter direction with respect to a moving direction of the surface of asid image bearing member.

* * * * *

UNITED STATES PATENT AND TRADEMARK OFFICE

CERTIFICATE OF CORRECTION

PATENT NO. : 6,070,047

DATED : May 30, 2000

INVENTOR(S) : Kimitaka ICHINOSE, et al.

It is certified that error appears in the above-identified patent and that said Letters Patent is hereby corrected as shown below:

COLUMN 1:

Line 26, "bharge" should read --charge--.

COLUMN 3:

Line 15, "a" should read --an--.

COLUMN 4:

Line 19, "stopped," should read --stopped, and--.

UNITED STATES PATENT AND TRADEMARK OFFICE

CERTIFICATE OF CORRECTION

PATENT NO. : 6,070,047

DATED : May 30, 2000

INVENTOR(S) : Kimitaka ICHINOSE, et al.

It is certified that error appears in the above-identified patent and that said Letters Patent is hereby corrected as shown below:

COLUMN 9:

Line 11, "of f" should read --off--.

COLUMN 11:

Line 4, "with" should be deleted.

COLUMN 12:

Line 31, "remained" should read --remainder--.

COLUMN 16:

Line 56, "spond" should read --sponds--.

COLUMN 17:

Line 47, "apparat us" should read --apparatus--.

UNITED STATES PATENT AND TRADEMARK OFFICE

CERTIFICATE OF CORRECTION

PATENT NO. : 6,070,047

DATED : May 30, 2000

INVENTOR(S) : Kimitaka ICHINOSE, et al.

It is certified that error appears in the above-identified patent and that said Letters Patent is hereby corrected as shown below:

COLUMN 18:

Line 60, "asid" should read --said--.

COLUMN 20:

Line 1, "asid" should read --said--.
Line 6, "asid" should read --said--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*